US010214789B2

(12) United States Patent
Carter et al.

(10) Patent No.: US 10,214,789 B2
(45) Date of Patent: Feb. 26, 2019

(54) QUENCH PLUG SYSTEMS AND THEIR USE

(71) Applicant: The Boeing Company, Chicago, IL (US)

(72) Inventors: Matthew D. Carter, Portland, OR (US); Richard G. Kummerle, Gresham, OR (US); David Salber, Damascus, OR (US)

(73) Assignee: The Boeing Company, Chicago, IL (US)

( * ) Notice: Subject to any disclaimer, the term of this patent is extended or adjusted under 35 U.S.C. 154(b) by 630 days.

(21) Appl. No.: 14/856,479

(22) Filed: Sep. 16, 2015

(65) Prior Publication Data

US 2017/0073783 A1 Mar. 16, 2017

(51) Int. Cl.

| | |
|---|---|
| ***C21D 1/62*** | (2006.01) |
| ***C21D 1/18*** | (2006.01) |
| ***C21D 9/00*** | (2006.01) |
| ***C21D 6/00*** | (2006.01) |

(52) U.S. Cl.

CPC ..... *C21D 1/62* (2013.01); *C21D 1/18* (2013.01); *C21D 6/00* (2013.01); *C21D 9/0068* (2013.01)

(58) Field of Classification Search

CPC ..... C21D 1/62; C21D 1/18; C21D 9/0068

See application file for complete search history.

(56) References Cited

U.S. PATENT DOCUMENTS 4,761,191 A 8/1988 Keller et al.
6,120,570 A 9/2000 Packer et al.

FOREIGN PATENT DOCUMENTS

DE 19608401 A1 9/1996

OTHER PUBLICATIONS

European Patent Office, Examination Report in European Patent Application No. 16189415.9, dated Dec. 21, 2017, 6 pages.

European Patent Office, Extended European Search Report in European Patent Application No. 16189415.9-1362, dated Feb. 8, 2017, 6 pages.

Bugliarello et al., Heat Treat Processes for Gears, GEARSolutions, URL: http://www.gearsolutions.com/article/detail/6005/heat-treat-processes-for-gears, Jul. 2010, 13 pages.

Reardon, Arthur C., Press Quenching and Effects of Prior Thermal History on Distortion during Heat Treatment, Geartechnology, URL: http://www.geartechnology.com/issues/0314x/press-quenching.pdf, Mar./Apr. 2014, 4 pages.

GH Induction India Pvt., Ltd., Plug Quenching and Press Quenching, URL: http://ghinduction.co.in/plug.html, circa before Jun. 11, 2015, 1 page.

*Primary Examiner* — Jessee R Roe

(74) *Attorney, Agent, or Firm* — Kolisch Hartwell, P.C.

(57) ABSTRACT

Quench plug systems and their use in heat treating a workpiece. The quench plug system includes a tapered plug having a longitudinal core axis and a mandrel configured to be interposed between the tapered plug and the workpiece. The tapered plug is configured to allow the mandrel to translate along the core axis of the tapered plug when the workpiece is heated.

21 Claims, 10 Drawing Sheets

QUENCH PLUG SYSTEMS AND THEIR USE

FIELD

This disclosure relates to systems and apparatus for metalworking. More particularly, this disclosure relates to heat treating and quenching a metal workpiece.

INTRODUCTION

Metalworking includes a variety of methods of working with metals or metal alloys to create individual parts, assemblies, or large-scale structures. One aspect of many metalworking techniques is quenching, or quickly reducing a temperature of the metal. The slower the quench rate (e.g., a relatively longer time to reduce the temperature of the metal), the longer thermodynamic forces have a chance to alter the microstructure of the metal, which may be desirable. In other cases, a faster quench rate is used to prevent the microstructure of the metal from altering significantly as it passes through a range of lower temperatures during cooling. Heating and quenching is most commonly carried out in order to harden a given manufactured component.

Where the manufactured component is thin and/or flat, the stresses of rapid quenching can sometimes result in distortion and warping of the workpiece. Such distortions may not meet a high degree of precision in the workpiece's dimensions and/or geometry.

One way of preventing or reducing such distortion is the insertion of a quench plug into an internal cavity of the workpiece while the workpiece is at high temperature, followed by quenching the assembled workpiece/quench plug. The quench plug may be configured to preserve the shape of the component while the component is being quenched. The presence of the quench plug may also result in a degree of plastic deformation of the component as the component cools and shrinks, thereby relieving stresses in the metal structure of the workpiece.

This process typically uses a quench plug that is at room temperature be inserted into a workpiece while the workpiece is hot, perhaps as hot as 1,600° F. (870° C.). In addition, the rigors of manually working with such hot materials may result in inconsistencies in the placement of the plug tool, or the timing of the quench delay. Further, the contraction of the workpiece around a misaligned quench plug may result in the plug being tightly held by the workpiece, and significant force may be applied to remove the quench plug, increasing the risk of altering the workpiece and adding to the cost of the heat treatment process.

SUMMARY

The present disclosure provides quench plug systems and methods for heat treating a workpiece.

In some aspects, the present disclosure provides a quench plug system for use in heat treating a workpiece, where the quench plug system includes a tapered plug having a longitudinal core axis, and a mandrel configured to be interposed between the tapered plug and the workpiece, where the tapered plug is configured to allow the mandrel to translate along the core axis of the tapered plug when the workpiece is heated.

In some aspects, the present disclosure provides a method for heat treating a workpiece that includes inserting a mandrel into a workpiece before the workpiece is heated, inserting a tapered plug having a core axis into the mandrel before the mandrel is heated, heating the workpiece so that the tapered plug translates along the core axis further into the mandrel during the heating step, and cooling the workpiece to form a final shape of the workpiece.

In some aspects, the present disclosure provides a method of heat treating a workpiece that includes inserting a plug inside a workpiece, heating the workpiece until the workpiece has expanded to a desired dimension, cooling the workpiece, and removing the plug from the workpiece, where the workpiece expands to and maintains a desired dimension without the insertion of any structure into the workpiece during either the heating or the cooling steps.

Features, functions, and advantages may be achieved independently in various embodiments of the present disclosure, or may be combined in yet other embodiments, further details of which can be seen with reference to the following description and drawings.

DESCRIPTION

Overview

Described herein is a quench plug system that can be placed with respect to a workpiece without an operator interacting with extremely hot materials. The herein-described quench plug system accommodates the expansion of the workpiece during heating and at least substantially resists the contraction of the workpiece during quenching. Further, the quench plug system may be readily removed after quenching is complete.

Various embodiments of quench plug systems and methods of heat treating a workpiece are described below and illustrated in the associated drawings. Unless otherwise specified, the quench plug systems of the present disclosure and/or their various components may, but are not required to, contain at least one of the structures, components, functionality, and/or variations described, illustrated, and/or incorporated herein. Furthermore, the structures, components, functionalities, and/or variations described, illustrated, and/or incorporated herein in connection with the present teachings may, but are not required to, be included in other similar quench plug systems. The advantages possessed or exhibited by selected aspects, as described below, are illustrative in nature. The following description of various aspects is exemplary in nature and is in no way intended to limit the disclosure, its application, or uses.

The embodiments of quench plug systems depicted in the associated drawings are selected to illustrate various aspects of the present disclosure, and one or more of the proportions, orientations, and relative spacing of the depicted quench plug components may be exaggerated for the purposes of such illustration. In particular, the amount of expansion of the workpiece and selected components of the depicted quench plug systems may be exaggerated.

The quench plug systems and methods of heat treating a workpiece described herein may possess particular utility for the heat treatment of selected metal workpieces, particularly but not exclusively where the workpiece may define an internal cavity. The disclosed systems and methods may permit the heat treatment of a workpiece that includes inserting the quench plug system into the workpiece when the workpiece is at or near room temperature, with the workpiece being heated to a higher temperature, and subsequently quenched. The quench plug systems disclosed herein may additionally be easy to remove after the quenching of the workpiece.

Figure 1:
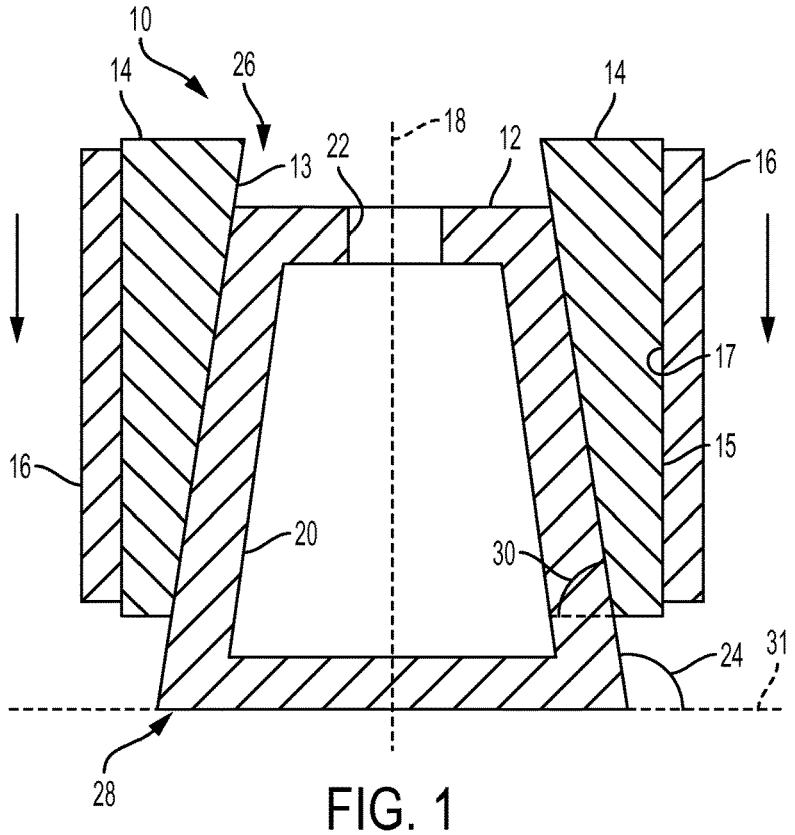
FIG. 1 is a cross-sectional diagrammatic representation of a workpiece coupled with a quench plug system according to the present disclosure, prior to heating.

FIG. 1 is a cross-section view of an exemplary quench plug system 10 that includes a tapered plug 12 configured to be inserted into a central cavity 13 of a mandrel 14. The exemplary quench plug system 10 is configured to be inserted at least substantially within a cavity defined by a workpiece 16. The tapered plug 12 may be substantially frusto-conical, the mandrel 14 may have an outer surface 15 that is substantially cylindrical, and the cavity defined by the workpiece 16 may have an inner surface 17 that is substantially cylindrical.

The tapered plug 12 and the mandrel 14 are constructed so that the mandrel 14 can expand at a faster rate than the tapered plug 12. This differential expansion may be effected by any satisfactory method, such as by differentially heating the mandrel 14 and the tapered plug 12 so that the mandrel 14 and the tapered plug 12 exhibit differential thermal expansion rates. Alternatively, or in addition, the materials forming the tapered plug 12 and the mandrel 14 may be selected to exhibit substantially different coefficients of thermal expansion if subjected to the same heating process. For example, the tapered plug 12 may include one or more materials having a relatively small coefficient of thermal expansion, such as for example Invar alloy and/or titanium metal. The mandrel 14 includes materials having a relatively larger coefficient of thermal expansion, such as for example a steel alloy. Alternatively, or in addition, the mandrel 14 may be constructed so that the mandrel 14 is mechanically capable of expanding in a radial direction.

Alternatively, or in addition, the tapered plug 12 may include a substantially nonconductive material, and the mandrel 14 and the workpiece 16 include conductive materials, such that by placing the quench plug system 10 and the workpiece 16 in an inductive heater, the workpiece 16 and the mandrel 14 may be subjected to an increased rate of heating compared to the rate of heating of the tapered plug 12. Similarly, both the tapered plug 12 and the mandrel 14 may include a substantially nonconductive material, while the workpiece 16 includes conductive materials, so that inductive heating heats the workpiece 16 at a rate of heating greater than that experienced by either the mandrel 14 or the tapered plug 12.

Figure 2:
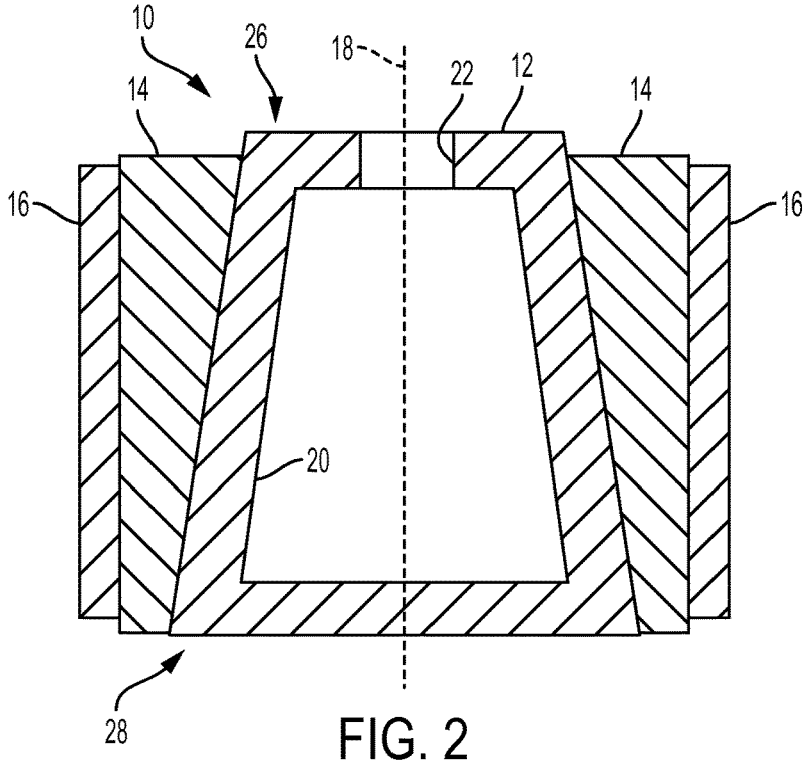
FIG. 2 is a cross-sectional diagrammatic representation of the workpiece and quench plug system of FIG. 1, after heating.

As shown in FIG. 1, the mandrel 14 may be configured so that the mandrel 14 may be interposed between the tapered plug 12 and the workpiece 16. FIG. 1 represents an initial state of the tapered plug 12, the mandrel 14, and the workpiece 16 prior to a heat treatment of the workpiece 16. At this initial state the quench plug system 10 and the workpiece 16 are substantially at room temperature before a heat treatment process is performed on the workpiece 16. During a heat treatment process, the workpiece 16 may undergo greater thermal expansion than the thermal expansion exhibited by the tapered plug 12, such that an increased inner circumference of the internal cavity of the workpiece 16, relative to the outer circumference of the tapered plug 12, may thereby allow the workpiece 16 and the mandrel 14 to translate downwardly along the tapered plug 12, as shown in FIG. 2. As the mandrel 14 translates downwardly along the tapered plug 12, the mandrel 14 may undergo a corresponding radial expansion.

As the workpiece 16 is subjected to subsequent cooling, or quenching, the workpiece 16 may contract. However, as the workpiece 16 comes into contact with the expanded mandrel 14, the workpiece 16 may be physically prevented from contracting further, resulting in a degree of plastic deformation of the workpiece 16 as the workpiece 16 continues to cool. The plastic deformation of the workpiece 16 relieves stresses in the metal structure of the workpiece 16 as the workpiece 16 undergoes forming and/or correction as the workpiece 16 is cooled.

As shown for the simplified embodiment depicted by FIGS. 1 and 2, the tapered plug 12, the mandrel 14, and the workpiece 16 may be constructed so that each of the tapered plug 12, the mandrel 15, and the workpiece 16 exhibits rotational symmetry with respect to a central core axis 18 of the tapered plug 12. That is, the tapered plug 12, the mandrel 14, and the workpiece 16 are nested in a substantially concentric fashion.

The tapered plug 12 includes an external taper having an outside taper angle 24. The tapered plug 12 may be substantially frusto-conical, or may be a truncated polygonal pyramid, such as a trigonal pyramid, a tetragonal pyramid, or any other suitable shape that enables the quench plug system 10 to function substantially as described herein. The tapered plug 12 may have a first end 26 and a second end 28, where the outside taper angle 24 results in the second end 28 having a larger circumference than a circumference of the first end 26. As the mandrel 14 and the workpiece 16 are heated, and therefore expand, the mandrel 14 and the workpiece 16 may translate along the tapered plug 12 toward the larger second end 28 of the tapered plug 12. The increasing circumference of the tapered plug 12 at the broader second end 28 of the tapered plug 12, relative to the circumference of the first end 26 of the tapered plug 12 may function to prevent any substantial subsequent radial contraction of the workpiece 16 as the workpiece 16 cools.

Tapered plug 12 may optionally include an internal cavity 20, which may be accessed via a plug opening 22. The plug opening 22 may be centered on the core axis 18 of the tapered plug 12.

As the workpiece 16 is heated the mandrel 14 may be configured to undergo an expansion as the mandrel 14 translates along the tapered plug 12 parallel to the core axis 18 toward the second end 28 of the tapered plug 12. The translation of the mandrel 14 along the core axis 18 may be facilitated when the mandrel 14 has an inside taper angle 30 that is substantially complementary to the outside taper angle 24 of the tapered plug 12, where the inside taper angle 30 and the outside taper angle 24 are measured relative to a plane 31 that is orthogonal to the core axis 18, as depicted in FIG. 1. The inside taper angle 30 and the outside taper angle 24 are complementary when the sum of the inside taper angle 30 and the outside taper angle 24 is substantially equal to 180 degrees. Alternatively, where the core axis 18 of the tapered plug 12 is defined as a vertical axis, then the absolute deviation of the inside taper angle 30 from the vertical axis and the absolute deviation of the outside taper angle 24 from the vertical axis are substantially equivalent.

The mandrel 14 may be reusable. For example, after expansion, the mandrel 14 may be removed from the tapered plug 12 and mechanically reconfigured to return to the mandrel's original circumference, for example by an inward radial compression. Alternatively, the mandrel 14 may be configured to undergo nonreversible expansion. In some aspects, a new mandrel may be used during each heat treatment process.

Figure 3:
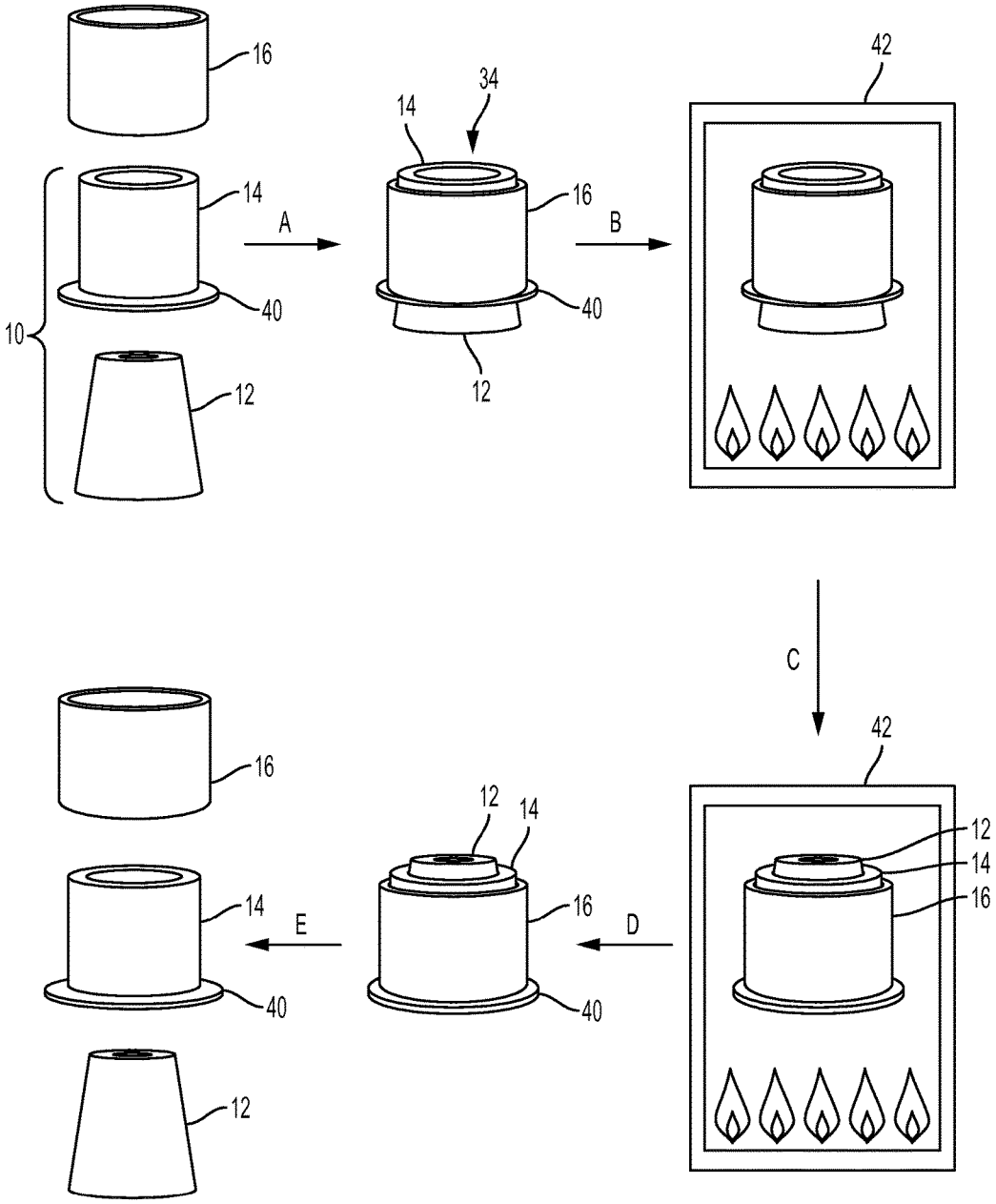
FIG. 3 is a schematic depiction of a method of heat treating a workpiece using a quench plug system according to the present disclosure.

A process of heat treating the workpiece 16 using the quench plug system 10 according to the present disclosure is shown schematically in FIG. 3. As depicted, the components of the quench plug system 10 may include the frusto-conical tapered plug 12, and the mandrel 14 that is complementary to the tapered plug 12, that is, the inside taper angle 30 of the mandrel 14 is complementary to the outside taper angle 24 of the tapered plug 12. The mandrel 14 may include a peripheral lip 40 along a circumference of its lower edge. The peripheral lip 40 may be configured to prevent the workpiece 16 from translating along the core axis 18 beyond the lower edge of the mandrel 14.

As shown at step A of the process of FIG. 3, the mandrel 14 may be interposed between the workpiece 16 and the tapered plug 12 prior to heating the workpiece 16. At step B, the combination of the workpiece 16 and the quench plug system 10 may be exposed to a heating device 42, for example a furnace or inductive heater. At step C, the workpiece 16 and the quench plug system 10 may be heated sufficiently by heat source 42 that the workpiece 16 and the mandrel 14 have translated parallel to and along the core axis 18 of the tapered plug 12 as the workpiece 16 radially expands. This permits the mandrel 14 to radially expand. At step D, the workpiece 16 and the quench plug system 10 are removed from the heating device 42 and permitted to cool to a relatively lower temperature, such as room temperature. Once the workpiece 16 has cooled to the relatively lower temperature, as shown at step E, the tapered plug 12 may be removed from the mandrel 14 and the mandrel 14 may be removed from the workpiece 16. At step E, the workpiece 16 has a desired shape.

Figure 4:
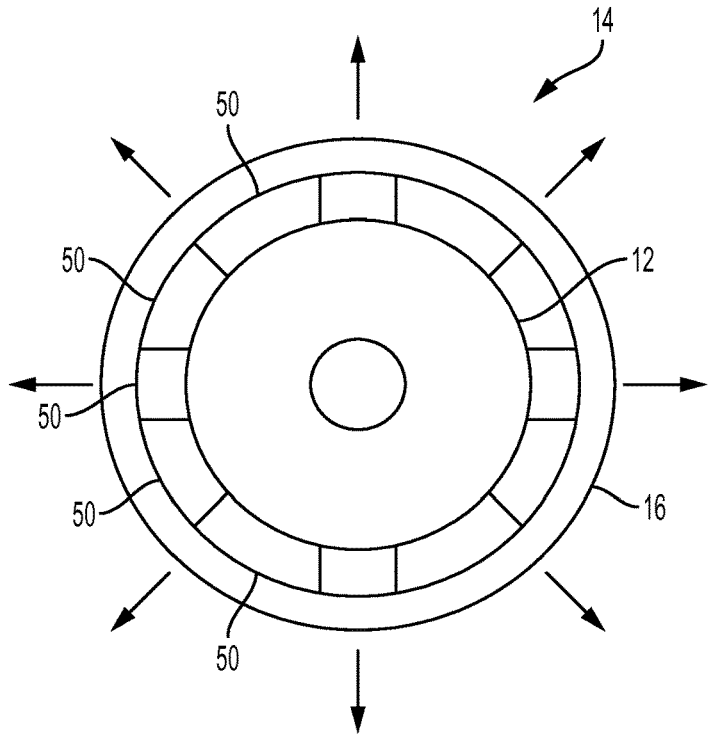
FIG. 4 is top view of a diagrammatic representation of an exemplary mandrel according to the present disclosure, before expanding.
Figure 5:
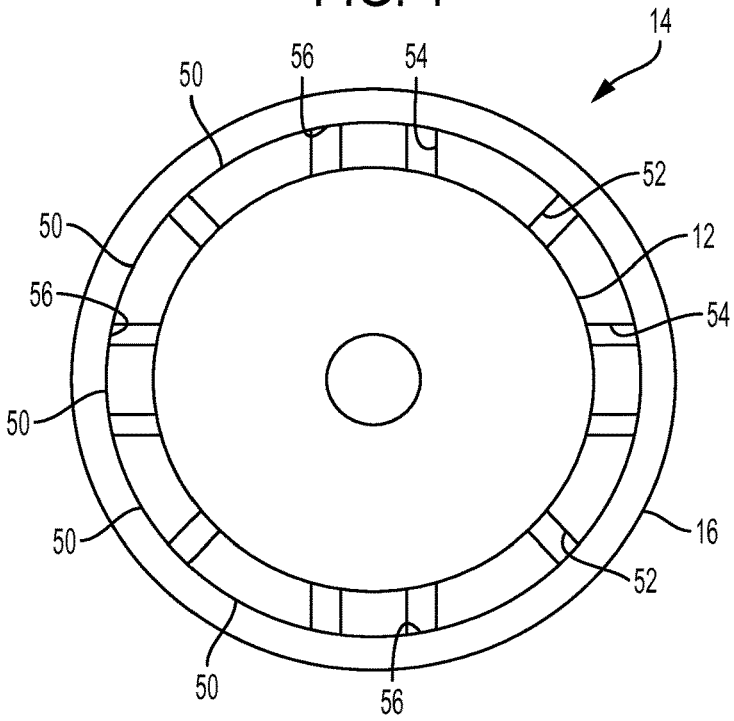
FIG. 5 is a top view of a diagrammatic representation of the exemplary mandrel of FIG. 4, after expanding.

FIGS. 4 and 5 schematically depict a selected configuration for a mandrel 16 according to the present disclosure. As shown from a top view in FIG. 4, the mandrel 14 may be interposed between the tapered plug 12 and the workpiece 16. The mandrel 14 may include multiple individual mandrel components 50. The mandrel components 50 may be configured so that by arranging the mandrel components 50 circumferentially adjacent to each other the mandrel 14 is formed. The mandrel components 50 may include multiple component sizes and/or shapes, provided that when the mandrel components 50 are appropriately arranged circumferentially adjacent to each other, the desired mandrel 14 is formed. The mandrel components 50 may correspond to radial sections of the mandrel 14 having substantially similar sizes and shapes. Alternatively, the mandrel components 50 may have distinct shapes and/or sizes, provided they assemble into the mandrel 14. As shown in FIGS. 4 and 5, the mandrel 14 may include individual mandrel components 50 having a side wall 52 that is coincident with a radius of the mandrel 14, or side wall 54 that is set at an angle to a radius of the mandrel 14, again provided that when the mandrel components 50 are appropriately arranged circumferentially adjacent to each other, the desired mandrel 14 is formed.

As the workpiece 16 is heated and expands, the workpiece 16 and the mandrel 14 may translate downwardly along the core axis 18 of the tapered plug 12. As the mandrel 14 moves along tapered plug 12, the individual mandrel components 50 of the mandrel 14 may separate from one another, introducing spaces 56 between the individual mandrel components 50, as shown in FIG. 5. Although the material of the mandrel components 50 may simultaneously undergo thermal expansion, the expansion of the mandrel 14 of FIG. 5 is primarily due to the introduction of the spaces 56 between the individual mandrel components 50. The radial expansion of the workpiece 16 and the mandrel 14 depicted in FIG. 5 may be exaggerated for the purposes of illustration.

Figure 6:
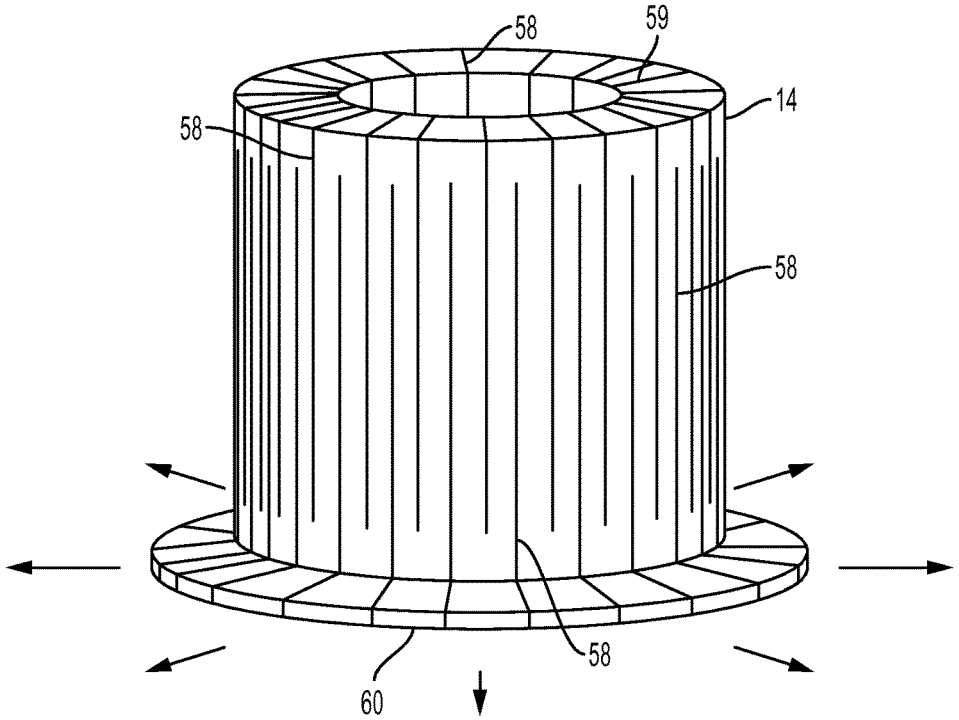
FIG. 6 is a perspective view of a diagrammatic representation of an exemplary mandrel according to the present disclosure, before expanding.
Figure 7:
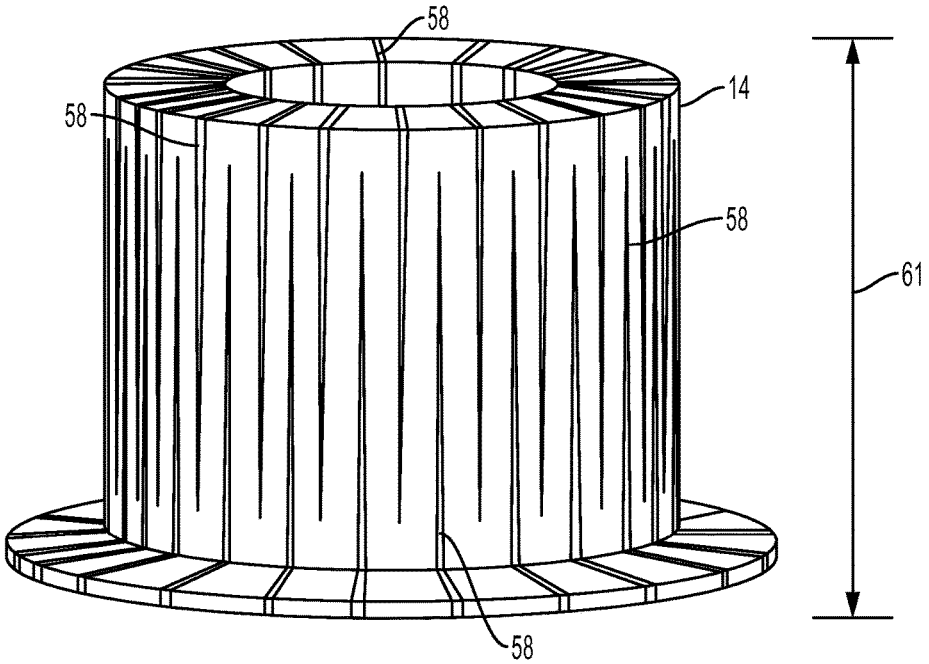
FIG. 7 is a perspective view of a diagrammatic representation of the exemplary mandrel of FIG. 6, after expanding.

FIGS. 6 and 7 schematically depict a selected configuration for a mandrel according to the present disclosure. As shown in a perspective view in FIG. 6, the mandrel 14 may incorporate a plurality of longitudinal slits 58 that originate alternately at an upper surface 59 and a lower surface 60 of the mandrel 14. Each longitudinal slit 58 extends in a direction parallel to the core axis 18 of the tapered plug 12 occupying the central cavity 13 of the mandrel 14. Each longitudinal slit 58 extends partly along a height 61 of the mandrel 16, but does not extend to the opposite surface of the mandrel 14 from the originating surface of the slit. By virtue of the slit construction, as the mandrel 14 translates along the core axis 18 of a tapered plug 12 from the first end 26 of the tapered plug 12 toward the second end 28 of the tapered plug 12 (shown in FIG. 1), the mandrel 14 may expand radially outwardly mechanically as the longitudinal slits 54 widen, as shown in FIG. 7.

In some configurations of the quench plug system of the present disclosure, the mandrel 14 may be configured to facilitate the use of a quench fluid to aid in quenching the workpiece. For example, the outer surface of the mandrel component may incorporate one or more recessed channels that may be configured to permit a quench fluid to circulate between the outer surface of the mandrel and the inner surface of a surrounding workpiece. In this way, contact between the quench fluid and the workpiece may be increased, and so the resulting rate of cooling of the workpiece may be increased. The recessed channels in the outer surface of the mandrel may be configured to circulate any appropriate quench fluid, including for example water, water mixed with one or more additives, organic or inorganic oils, or inert gases, among others.

The quench plug systems of the present disclosure may incorporate mandrels having an additional or alternative configuration, without limitation, provided that the mandrel may be appropriately interposed between the tapered plug of the quench plug system and the workpiece of interest, and further provided that the mandrel is additionally configured to translate along the core axis of the tapered plug when the workpiece and optionally the quench plug system is heated.

EXAMPLES, COMPONENTS, AND ALTERNATIVES

The following sections describe selected aspects of exemplary quench plug systems and methods of heat treating a workpiece that employ such exemplary quench plug systems. The examples in these sections are intended for illustration and should not be interpreted as limiting the entire scope of the present disclosure.

Example 1

This example describes an illustrative quench plug system 10 according to an embodiment of the present disclosure, as shown in cross-section views in FIGS. 8-11.

Figure 8:
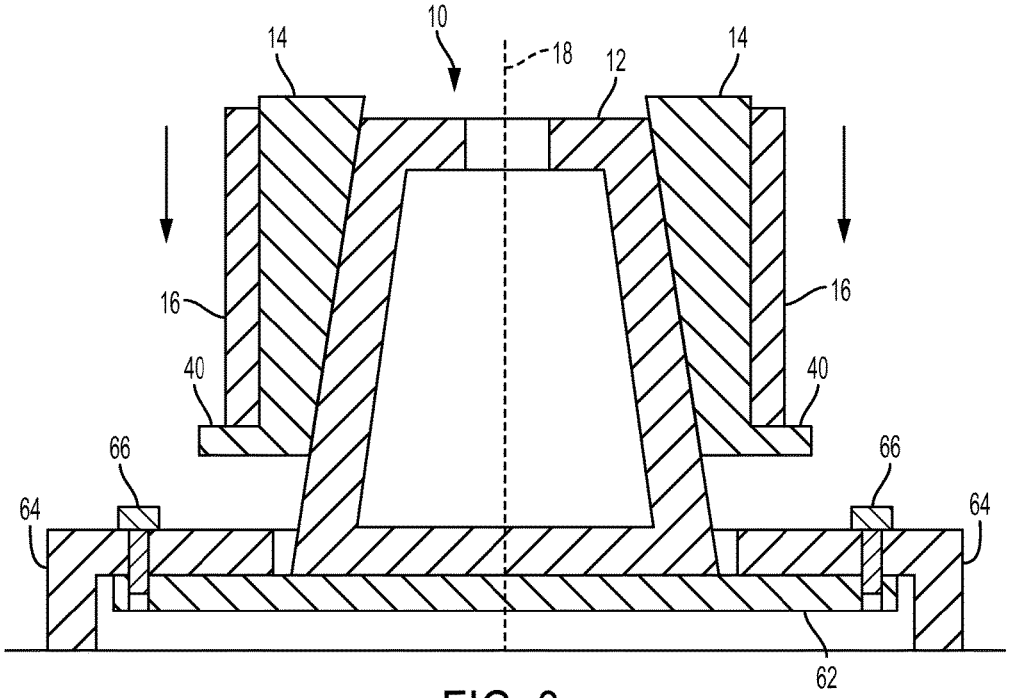
FIG. 8 is a cross-sectional diagrammatic representation of a workpiece coupled with a quench plug system according to the present disclosure, prior to heating.
Figure 9:
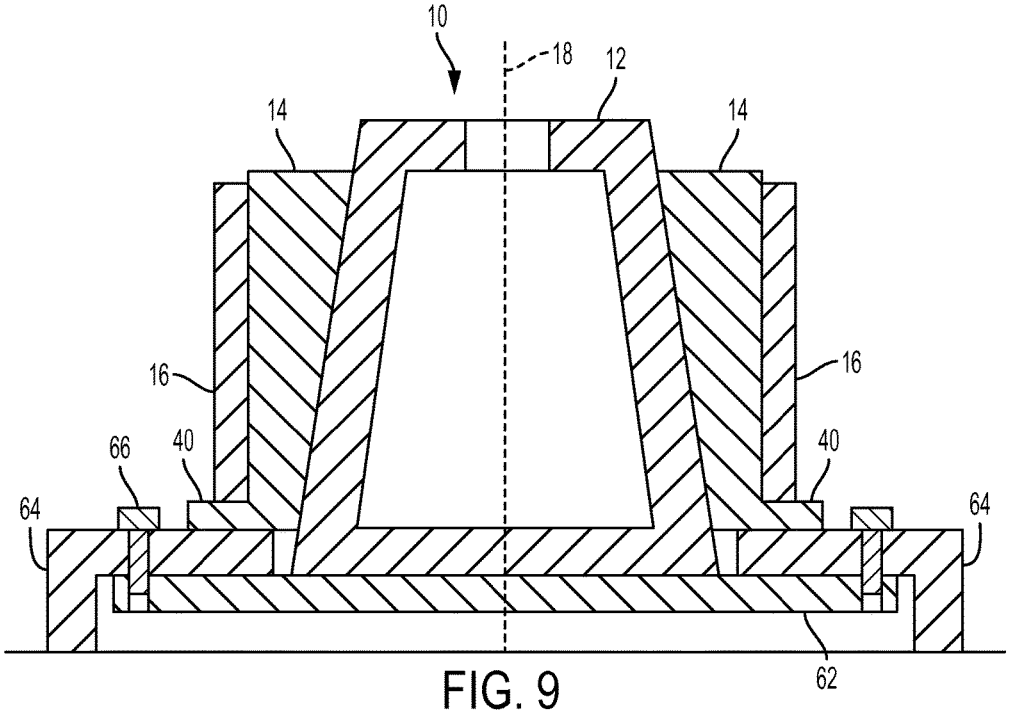
FIG. 9 is a cross-sectional diagrammatic representation of the workpiece and quench plug system of FIG. 8, after heating.

FIG. 8 is a cross-section view of an illustrative quench plug system 10 that includes the tapered plug 12, and the mandrel 14. The tapered plug 12 additionally includes a plate 62 that is oriented orthogonally to the core axis 18 of tapered plug 12. The plate 62 may be secured to tapered plug 12. The tapered plug 12 may additionally be secured to a base 64 by coupling the plate 62 of the tapered plug 12 beneath the base 64 so that the tapered plug 12 extends along the core axis 18 from the base 64. As shown in FIGS. 8 and 9, the horizontal plate 62 may secured to the base 64 by the fasteners 66. The fasteners 66 may be screws, bolts, or any other appropriate fastening device that secure the plate 62 to the base 64.

The mandrel 14 may include a peripheral lip 40 along an edge of the mandrel 14 adjacent to the base 64 in order to prevent the workpiece 16 from translating beyond the peripheral lip 40.

As shown in FIGS. 8 and 9, upon heating the workpiece 16, the workpiece 16 and the mandrel 16 translate along the core axis 18 of the tapered plug 12 under the effect of gravity. The mandrel 14 may translate along the core axis 18 only until the mandrel 14 makes contact with the base 64, as shown in FIG. 9. The exemplary configuration of the quench plug system 10 may be useful where it is desirable to limit a degree of expansion of the workpiece 16.

Figure 10:
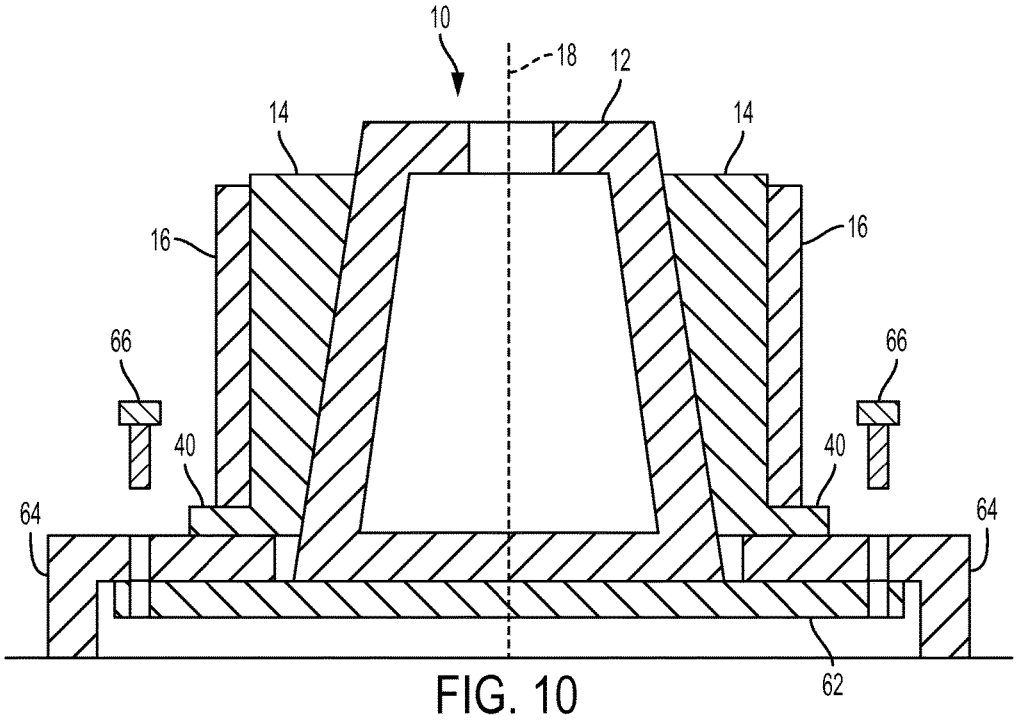
FIG. 10 is a cross-sectional diagrammatic representation of a workpiece and quench plug system of FIG. 9, in a disassembly process.
Figure 11:
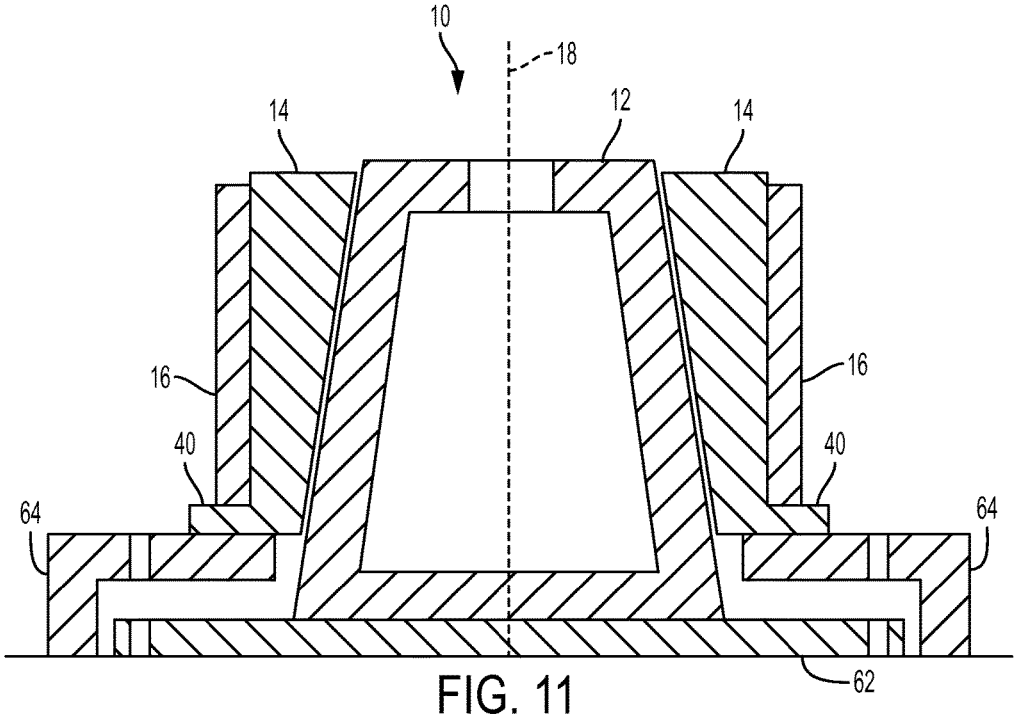
FIG. 11 is a cross-sectional diagrammatic representation of the workpiece and quench plug system of FIG. 10, in a disassembly process.

After cooling, the fasteners 66 may be removed from the base 64 and the plate 62, as shown in FIG. 10. The tapered plug 12 may then be removed from the mandrel 14 by translating the tapered plug 12 along the core axis 18, as shown in FIG. 11.

Example 2

Figure 12:
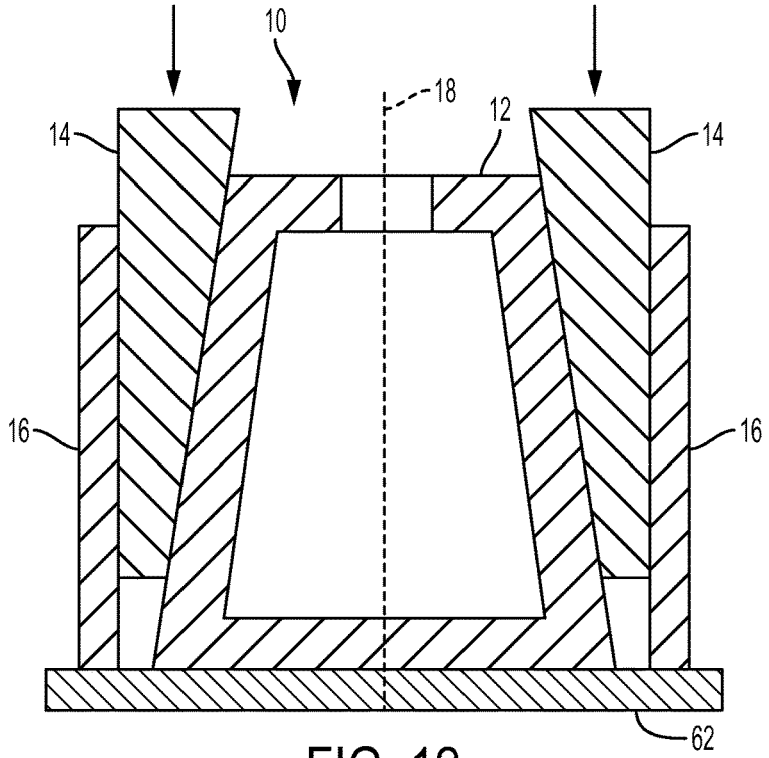
FIG. 12 is a cross-sectional diagrammatic representation of a workpiece coupled with a quench plug system according to the present disclosure, prior to heating.
Figure 13:
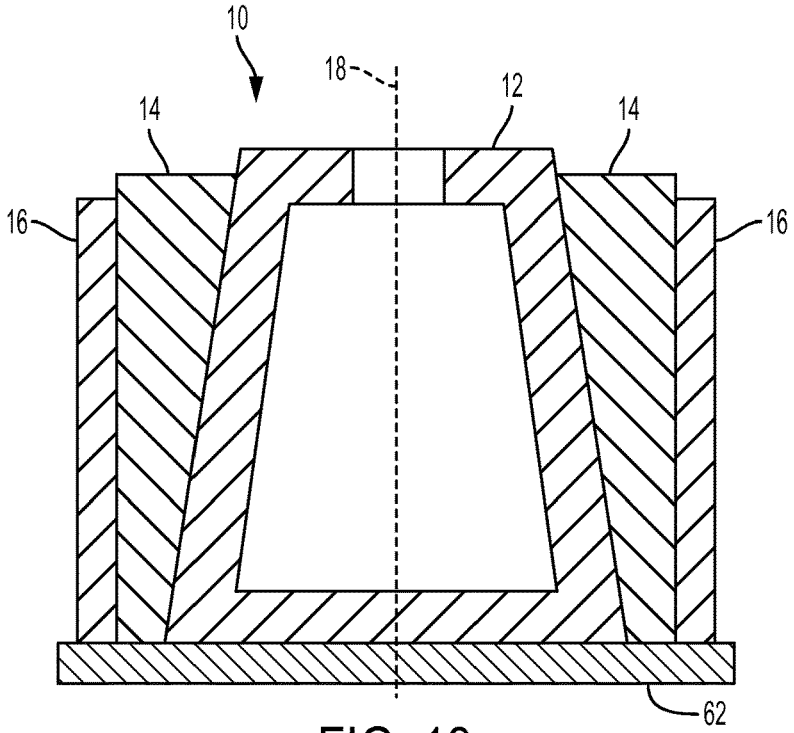
FIG. 13 is a cross-sectional diagrammatic representation of the workpiece and quench plug system of FIG. 12, after heating.

This example describes the illustrative quench plug system 10 according to an embodiment of the present disclosure, as shown in cross-section views in FIGS. 12 and 13.

FIG. 12 is a cross-section view of the illustrative quench plug system 10 that may include the tapered plug 12, and the mandrel 14. The tapered plug 12 may additionally include the plate 62 oriented orthogonally to the core axis 18 of the tapered plug 12. The mandrel 14 may be interposed between the tapered plug 12 and the workpiece 16. FIG. 12 depicts the quench plug system 10 before the workpiece 16 is heated.

Unlike the quench plug system 10 of FIGS. 1 and 2, the quench plug system 10 is configured so that the mandrel 14 and the workpiece 16 translate independently from each other along the core axis 18 relative to the tapered plug 12 when the workpiece 16 is heated. In particular, as the workpiece 16 is heated and expands, the mandrel 14 may translate downwardly along the core axis 18 of the tapered plug 12 under the effect of gravity. The mandrel 14 may be limited in its downward translation by contact between the mandrel 14 and the plate 62.

Example 3

Figure 14:
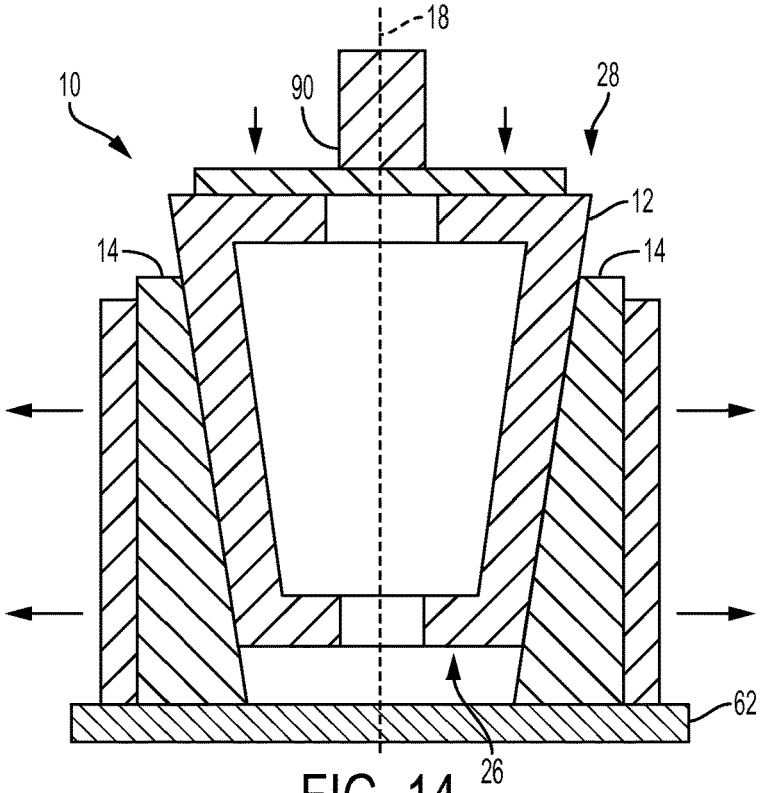
FIG. 14 is a cross-sectional diagrammatic representation of a workpiece coupled with a quench plug system according to the present disclosure, prior to heating.
Figure 15:
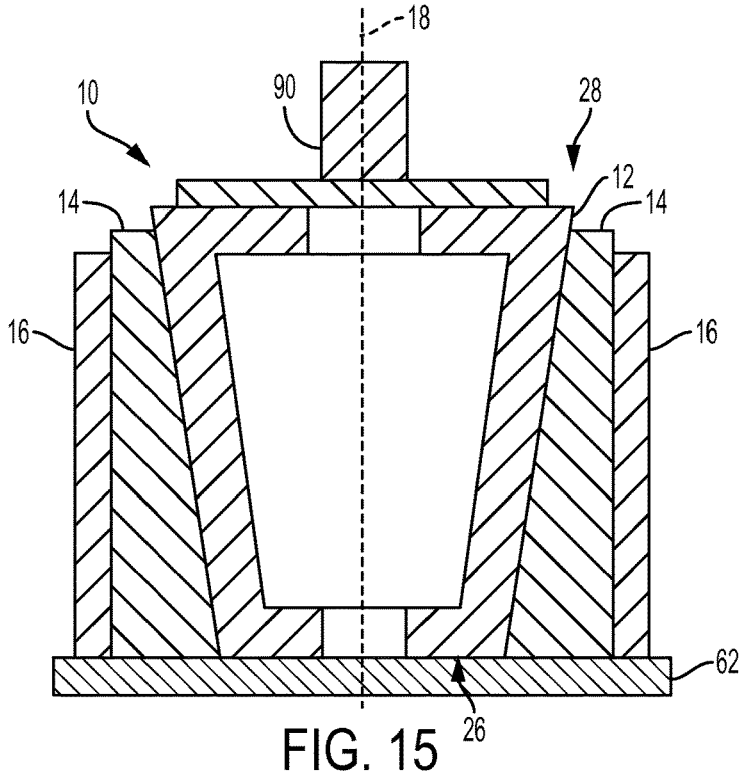
FIG. 15 is a cross-sectional diagrammatic representation of the workpiece and quench plug system of FIG. 14, after heating.

This example describes the illustrative quench plug system 10 according to an embodiment of the present disclosure, as shown in cross-section views in FIGS. 14 and 15.

FIG. 14 is a cross-section view of the illustrative quench plug system 10 that includes the tapered plug 12, and the mandrel 14. The tapered plug 12 is configured to allow the mandrel 14 to translate along the core axis 18 of the tapered plug 12 when the workpiece 16 is heated. The tapered plug 12 includes the first end 26 and the second end 28, where the second end 28 has a larger circumference than the circumference of the first end 26. The quench plug system 10 further includes the plate 62 that is oriented orthogonally to the core axis 18 of the tapered plug 12; however, in contrast to the quench plug system 10 of FIGS. 12 and 13, the plate 62 is disposed adjacent to but spaced from the first end 26 of the tapered plug 12.

The quench plug system 10 may be configured so that upon heating the workpiece 16, the tapered plug 12 may translate toward the plate 62. As the tapered plug 12 translates toward the plate 62, the mandrel 14 may translate along the core axis 18 of the tapered plug 12 toward the second end 28 of the tapered plug 12, expanding as it does so. The tapered plug 12 can translate along the core axis 18 until the first end 26 of the tapered plug 12 meets the plate 62. as shown in FIG. 15, at which point the quench plug system 10 and the workpiece 16 may be cooled.

The quench plug system 10 may further include a press 90 configured to apply a force (in addition to gravitational force) to assist in translating tapered plug 12 toward the plate 62. The force may be applied to one or more of the tapered plug 12, the mandrel 14, or both components of the particular quench plug system 10, and such forces may be applied parallel to the core axis 18 of the tapered plug 12 of the particular quench plug system 10.

Example 4

Figure 16:
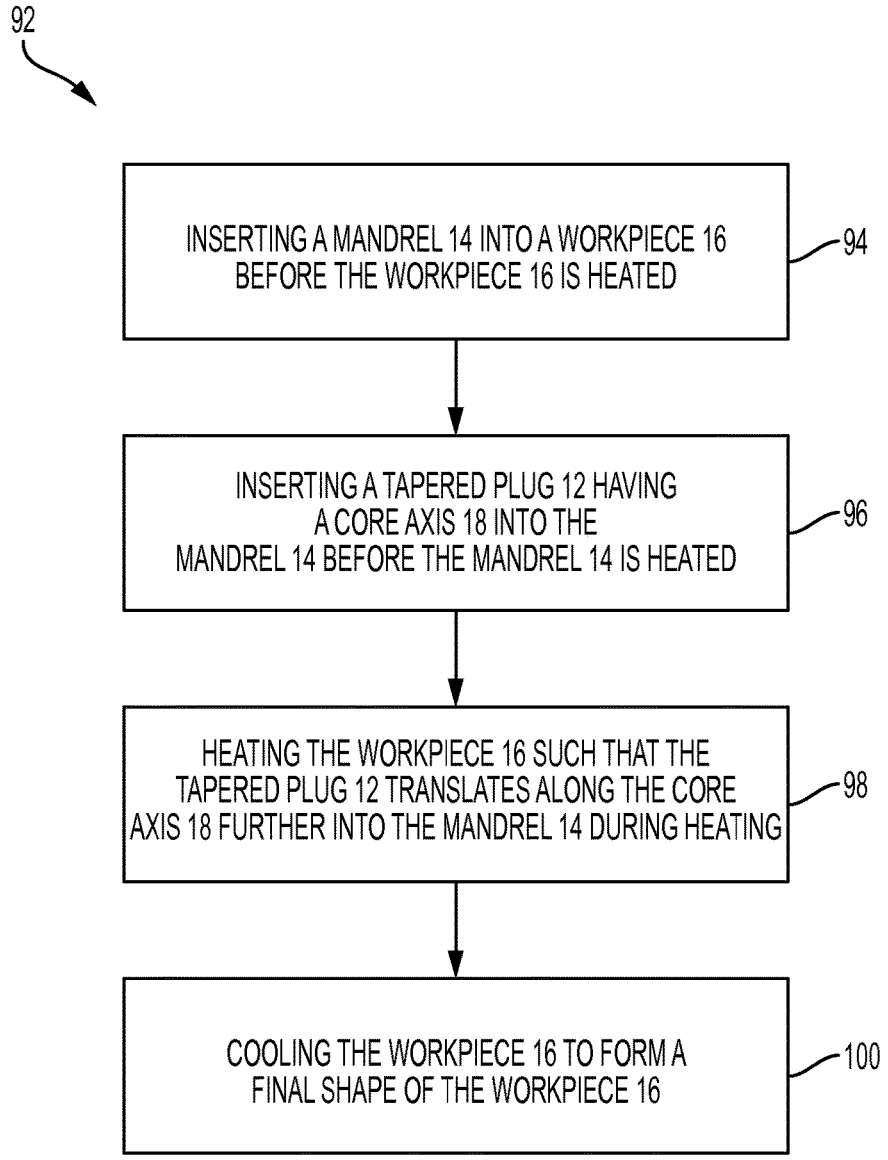
FIG. 16 is a flowchart depicting an illustrative method for heat treating a workpiece, according to the present disclosure.

An illustrative method of heat treating a workpiece 16 is depicted by flowchart 92 of FIG. 16. As depicted, the illustrative method includes inserting a mandrel 14 into a workpiece 16 before the workpiece 16 is heated (at 94 of flowchart 92), inserting a tapered plug 12 having a core axis 18 into the mandrel 14 before the mandrel 14 is heated (at 96 of flowchart 92), heating the workpiece 16 such that the tapered plug 12 translates along the core axis 18 further into the mandrel 14 during the heating step (at 98 of flowchart 92), and cooling the workpiece 16 to form a final shape of the workpiece 16 (at 100 of flowchart 92).

Example 5

Figure 17:
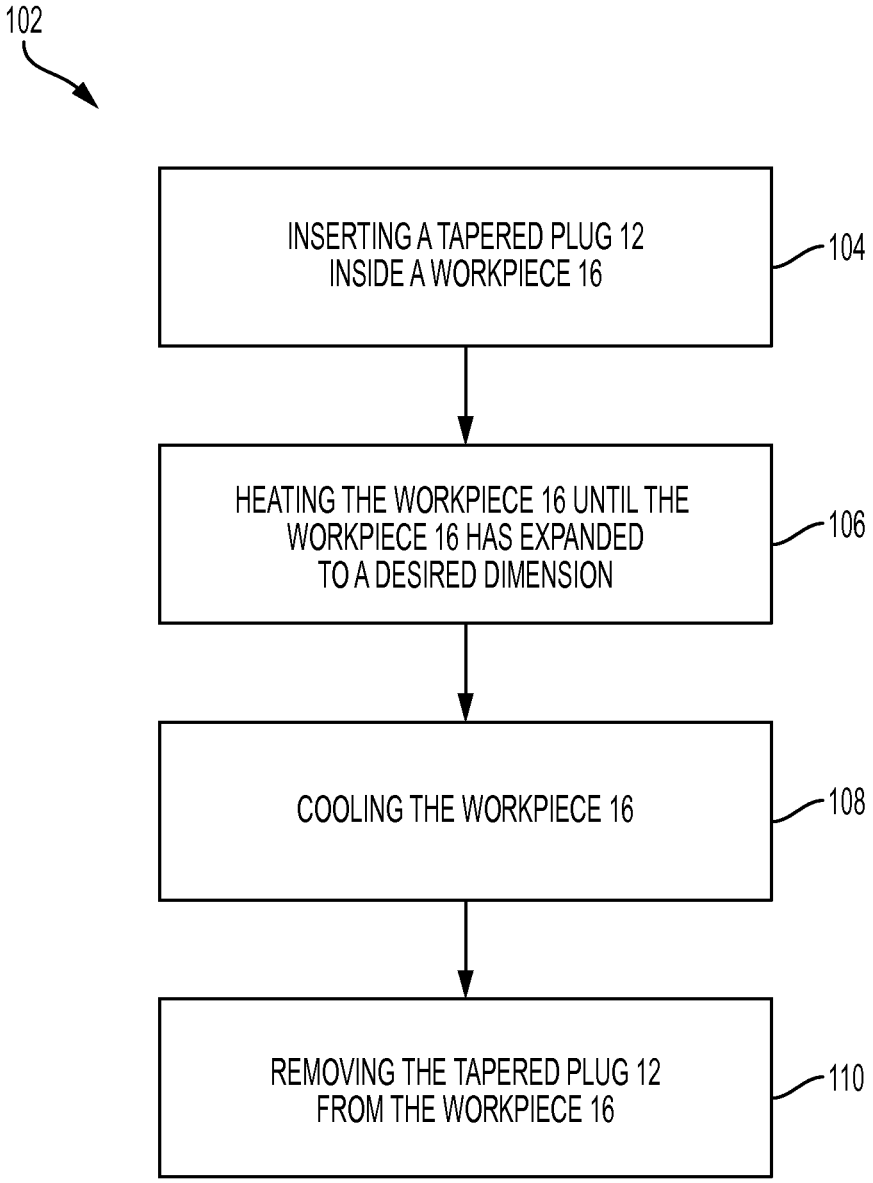
FIG. 17 is a flowchart depicting an illustrative method for heat treating a workpiece, according to the present disclosure.

An alternative illustrative method of heat treating a workpiece 16 is depicted by flowchart 102 of FIG. 17. As depicted, the illustrative method includes inserting a tapered plug 12 inside a workpiece 16 (at 104 of flowchart 102), heating the workpiece 16 until the workpiece 16 has expanded to a desired dimension (at 106 of flowchart 102), cooling the workpiece 16 (at 108 of flowchart 102), and removing the tapered plug 12 from the workpiece 16 (at 110 of flowchart 102), where the workpiece 16 expands to and maintains a desired dimension without the insertion of any structure into the workpiece during either the heating or the cooling steps.

Example 6

This section describes additional aspects and features of the quench plug systems and methods of heat treating a workpiece, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A quench plug system (10) for use in heat treating a workpiece (16), the quench plug system (10) comprising:

a tapered plug (12) having a longitudinal core axis (18); and a mandrel (14) configured to be interposed between the tapered plug (12) and the workpiece (16), wherein the tapered plug (12) is configured to allow the mandrel (14) to translate along the core axis (18) of the tapered plug (12) when the workpiece (16) is heated.

A1. The quench plug system (10) of paragraph A0, wherein the tapered plug (12) has a first end (26) and a second end (28), the second end (28) having a larger circumference than a circumference of the first end (26).

A2. The quench plug system (10) of paragraph A0, wherein the tapered plug (12) has a lower coefficient of thermal expansion than a coefficient of thermal expansion of the workpiece (16) or a coefficient of thermal expansion of the mandrel (14).

A3. The quench plug system (10) of paragraph A0, wherein the tapered plug (12) includes at least one of an Invar alloy or titanium metal.

A4. The quench plug system (10) of paragraph A0, wherein the tapered plug (12) has an outside taper angle (24) and the mandrel (14) has an inside taper angle (30), and the outside taper angle (24) of the tapered plug (12) is complementary to the inside taper angle (30) of the mandrel (14).

A5. The quench plug system (10) of paragraph A0, wherein the tapered plug (12) is substantially frusto-conical, the mandrel (14) has an outer surface (15) that is substantially cylindrical, and the workpiece (16) has an inner surface (17) that is substantially cylindrical.

A6. The quench plug system (10) of paragraph A0, wherein the mandrel (14) includes a plurality of individual mandrel components (50), such that when the mandrel (14) translates along the core axis (18) of the tapered plug (12) the outer diameter of the mandrel (14) increases.

A7. The quench plug system (10) of paragraph A0, wherein the mandrel (14) includes a plurality of longitudinal slits (52) originating alternately from an upper surface (56) and a lower surface (58) of the mandrel (14), each longitudinal slit (52) extending a portion of a height (60) of the mandrel (14).

A8. The quench plug system (10) of paragraph A0, wherein the mandrel (14) and the workpiece (16) translate along the core axis (18) together relative to the tapered plug (12) when the workpiece (16) is heated.

A9. The quench plug system (10) of paragraph A0, wherein the mandrel (14) and the workpiece (16) translate independently from each other along the core axis (18) relative to the tapered plug (12) when the workpiece (16) is heated.

A10. The quench plug system (10) of paragraph A0, wherein the workpiece (16) and the mandrel (14) are configured to translate along the tapered plug (12) under gravity when the workpiece (16) is heated.

A11. The quench plug system (10) of paragraph A0, further comprising a base (64) that is configured to be coupled to the tapered plug (12).

A12. The quench plug system (10) of paragraph A0, wherein the tapered plug (12) includes a substantially non-conductive material, the quench plug system (10) further comprising an inductive heater configured for heating the workpiece and the mandrel without substantially heating the tapered plug.

B0. A method for heat treating a workpiece (16), the method comprising:

inserting a mandrel (14) into a workpiece (16) before the workpiece (16) is heated, inserting a tapered plug (12) having a core axis (18) into the mandrel (14) before the mandrel (14) is heated, heating the workpiece (16) such that the tapered plug (12) translates along the core axis (18) further into the mandrel (14) during the heating step, and cooling the workpiece (16) to form a final shape of the workpiece (16).

B1. The method of paragraph B0, wherein the tapered plug (12) includes a first end (26) and a second end (28), the second end (28) having a larger circumference than a circumference of the first end (26); and wherein heating the mandrel (14) and the workpiece (16) includes translating the mandrel (14) along the core axis (18) toward the second end (28) of the tapered plug (12).

B2. The method of paragraph B0, further comprising translating the workpiece (16) and the mandrel (14) along the core axis (18) relative to the tapered plug (12) during the heating step, where the workpiece (16) and the mandrel (14) translate together or independently relative to the tapered plug (12).

B3. The method of paragraph B0, wherein heating the mandrel (14) and the workpiece (16) includes translating the tapered plug (12) along the core axis (18) of the tapered plug (12) relative to both the mandrel (14) and the workpiece (16).

B4. The method of paragraph B0, further comprising translating the mandrel (14) and the workpiece (16) along the core axis (18) relative to the tapered plug (12) at least partially due to a gravitational force.

B5. The method of paragraph B0, further comprising translating the mandrel (14) and the workpiece (16) relative to the tapered plug (12) at least partially due to a mechanical force.

B6. The method of paragraph B0, further comprising removing the tapered plug (12) and mandrel (14) from the workpiece (16) after the cooling step.

C0. A method of heat treating a workpiece, comprising inserting a tapered plug (12) inside a workpiece (16);

heating the workpiece (16) until the workpiece (16) has expanded to a desired dimension;

cooling the workpiece (16); and removing the tapered plug (12) from the workpiece (16), wherein the workpiece (16) expands to and maintains a desired dimension without the insertion of any structure into the workpiece (16) during either the heating or the cooling steps.

ADVANTAGES, FEATURES, BENEFITS

The different embodiments of the quench plug systems and methods of heat treating a workpiece described herein provide several advantages over known approaches to prevent the warping of metal components when they are heat treated and quenched.

The current use of quench plugs in the heat treatment of metal components requires a cool quench plug to be inserted into a workpiece that is already at high temperature. To avoid the high temperatures, placement of the quench plug may be rushed, and therefore the quench plug may not be optimally positioned in the workpiece. After quenching, the quench plug may be retained in the workpiece by the contraction of the workpiece and therefore difficult to remove.

The quench plug systems of the present disclosure permit the quench plug system to be inserted into the workpiece before the quench plug system or the workpiece is heated. The combined workpiece and quench plug system may be heated together, and then quenched directly, without manual intervention. Due to its construction the quench plug system does not substantially contract upon cooling, permitting the quench plug system to preserve the desired shape of the workpiece during quenching, and relieve stresses that might otherwise be created in the metal structure of the workpiece.

No known quench plug system or device can perform these functions. However, not all embodiments described herein may provide the same advantages or the same degree of advantage.

CONCLUSION

The specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the embodiment(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different embodiment or to the same embodiment, and whether broader, narrower, equal, or different in scope to the original claims, also are regarded as included within the subject matter of the embodiment(s) of the present disclosure.

We claim:

1. A quench plug system for use in heat treating a workpiece, the quench plug system comprising:

a tapered plug having a longitudinal core axis; and a mandrel configured to be interposed between the tapered plug and the workpiece, wherein the tapered plug is configured to allow the mandrel to translate along the core axis of the tapered plug when the workpiece is heated.

2. The quench plug system of claim 1, wherein the tapered plug has a first end and a second end, the second end having a larger circumference than a circumference of the first end.

3. The quench plug system of claim 1, wherein the tapered plug has a lower coefficient of thermal expansion than a coefficient of thermal expansion of the workpiece or a coefficient of thermal expansion of the mandrel.

4. The quench plug system of claim 1, wherein the tapered plug includes at least one of a nickel-iron alloy or titanium metal.

5. The quench plug system of claim 1, wherein the tapered plug has an outside taper angle and the mandrel has an inside taper angle, and the outside taper angle of the tapered plug is complementary to the inside taper angle of the mandrel.

6. The quench plug system of claim 1, wherein the tapered plug is substantially frusto-conical, the mandrel has an outer surface that is substantially cylindrical, and the workpiece has an inner surface that is substantially cylindrical.

7. The quench plug system of claim 1, wherein the mandrel includes a plurality of individual mandrel components, such that when the mandrel translates along the core axis of the tapered plug the outer diameter of the mandrel increases.

8. The quench plug system of claim 1, wherein the mandrel includes a plurality of longitudinal slits originating alternately from an upper surface and a lower surface of the mandrel, each longitudinal slit extending a portion of a height of the mandrel.

9. The quench plug system of claim 1, wherein the mandrel and the workpiece translate along the core axis together relative to the tapered plug when the workpiece is heated.

10. The quench plug system of claim 1, wherein the mandrel and the workpiece translate independently from each other along the core axis relative to the tapered plug when the workpiece is heated.

11. The quench plug system of claim 1, wherein the workpiece and the mandrel are configured to translate along the tapered plug under gravity when the workpiece is heated.

12. The quench plug system of claim 1, further comprising a base that is configured to be coupled to the tapered plug.

13. The quench plug system of claim 1, wherein the tapered plug includes a substantially nonconductive material, the quench plug system further comprising an inductive heater configured for heating the workpiece and the mandrel without substantially heating the tapered plug.

14. A method for heat treating a workpiece, the method comprising:

inserting a mandrel into a workpiece before the workpiece is heated, inserting a tapered plug having a core axis into the mandrel before the mandrel is heated, heating the workpiece such that the tapered plug translates along the core axis further into the mandrel during the heating step, and cooling the workpiece to form a final shape of the workpiece.

15. The method of claim 14, wherein the tapered plug includes a first end and a second end, the second end having a larger circumference than a circumference of the first end; and wherein heating the mandrel and the workpiece includes translating the mandrel along the core axis toward the second end of the tapered plug.

16. The method of claim 14, further comprising translating the workpiece and the mandrel along the core axis relative to the tapered plug during the heating step, where the workpiece and the mandrel translate together or independently relative to the tapered plug.

17. The method of claim 14, wherein heating the mandrel and the workpiece includes translating the tapered plug along the core axis of the tapered plug relative to both the mandrel and the workpiece.

18. The method of claim 14, further comprising translating the mandrel and the workpiece along the core axis relative to the tapered plug at least partially due to a gravitational force.

19. The method of claim 14, further comprising translating the mandrel and the workpiece relative to the tapered plug at least partially due to a mechanical force.

20. The method of claim 14, further comprising removing the tapered plug and mandrel from the workpiece after the cooling step.

21. A method of heat treating a workpiece, comprising inserting a tapered plug inside a workpiece;

heating the workpiece until the workpiece has expanded to a desired dimension;

cooling the workpiece; and removing the tapered plug from the workpiece, wherein the workpiece expands to and maintains a desired dimension without the insertion of any structure into the workpiece during either the heating or the cooling steps.

* * * * *